United States Patent [19]

Tomminen

[11] Patent Number: 4,923,379

[45] Date of Patent: May 8, 1990

[54] APPARATUS FOR CUTTING HOLLOW-CORED CONCRETE SLABS

[75] Inventor: Hannu Tomminen, Nurmijärvi, Finland

[73] Assignee: Parma Oy, Forssa, Finland

[21] Appl. No.: 200,442

[22] Filed: May 26, 1988

[30] Foreign Application Priority Data

May 28, 1987 [FI] Finland ..... 872372

[51] Int. Cl.[5] ..... B28B 11/16

[52] U.S. Cl. ..... 425/63; 83/679; 83/862; 83/875; 425/296; 425/302.1; 425/515

[58] Field of Search ..... 425/63, 64, 515, 219, 425/220, 296, 298, 301, 302.1, 306, 307, 308; 83/679, 697, 862, 875

[56] References Cited

U.S. PATENT DOCUMENTS

| | | | |
|---|---|---|---|
| 3,217,375 | 11/1965 | Kinnard | 425/219 |
| 3,771,932 | 11/1973 | van Daal | 425/302.1 |
| 4,592,916 | 6/1986 | Akesson | 425/298 |
| 4,608,902 | 9/1986 | Ivey | 83/875 |
| 4,798,118 | 1/1989 | Carithers, Jr. | 83/875 |

FOREIGN PATENT DOCUMENTS

| | | | |
|---|---|---|---|
| 0207574 | 1/1987 | European Pat. Off. | 425/307 |
| 2356603 | 6/1974 | Fed. Rep. of Germany | 425/302.1 |

*Primary Examiner*—James C. Housel

[57] ABSTRACT

An apparatus for the instant cutting of hollow-cored concrete slabs wherein the cast cored slabs are subjected to an instant cutting operation prior to the hardening of the concrete mix in such a manner that exposes the cores and the ends of the cores are filled to avoid jointing mix from intruding into the cores. The instant cutting is performed by driving two sheet-shaped cutting blades (3), which are mutually placed in a V-shaped posture, through the slab to make cutting tips (10) of the blades (3) meet at the bottom of the slab. A cutting knife (1), whose sides (16) face the mix and are disposed essentially parallel to the cutting blades (3), is driven through the slab, between the cutting blades (3), towards the cutting tips (10) of the blades (3). When the end cutting knife (1) reaches its lower position, the cutting blades (3) are lifted up, and the thus formed homogeneous sheet (17) of mix is pushed by means of the end cutting knife (1) to adhere to a cutting surface (18) formed by the cutting blades on the slab.

3 Claims, 2 Drawing Sheets

APPARATUS FOR CUTTING HOLLOW-CORED CONCRETE SLABS

BACKGROUND AND SUMMARY OF THE INVENTION

The present invention relates to a method for cutting hollow-cored concrete slabs.

The present invention also concerns an apparatus for implementing the method.

In the production of hollow-cored concrete slabs, the slabs are conventionally cast on long beds using a continuous slip-forming extrusion method. In their typical form, the cored slabs are prestressed structures cast from relatively stiff mixes. Immediately after completion of the casting phase, openings and recesses are worked into the slabs according to the individual specifications of construction drawings. Working is performed using manual methods by first measuring the elements with a tape measure and marking the cutting points of elements. Referencing the cutting point, the position of each opening is measured and marked, after which manual tools are used to scrape the openings free of unhardened mix that is then placed in a waste mix container. In some cases, the ends of slabs are trimmed immediately after the casting operation prior to the hardening of the mix. The immediate cutting is most typically performed using manual tools, e.g., a circular saw.

In some cases the immediate cutting is made over such a wide length (10 . . . 20 cm) that the ends of hollow cores are visible from the cutting point, allowing the ends to be filled with concrete mortar or mix using manual methods.

In the next phase the entire set of cored slabs is covered with a protective blanket until the final setting of the concrete. When the concrete has attained a sufficient strength, it is possible to cut the prestressing tendons at the ends of the slabs. Most typically, the slabs are cut by using a circular saw with a diamond-tipped blade, which is capable of cutting the set concrete, in addition to the tendons. Next, the elements can be transferred from the casting bed to be bundled and then placed into final storage until they are later transported to the construction site. Prior to storage, however, the ends of the hollow cores are always stoppered by a suitable type of plug so that the jointing mix applied at the construction site to the joint between the element ends is not able to flow into and fill up the cores. Consequently, the stopper plugs of the hollow cores in the cored element, in practice, perform as casting plugs, but they may also be applicable as supports for the wall constructions resting on the ends of cored slab. The type of plug conventionally used is a cast concrete plug or a detachable, cup-shaped, molded plastic plug.

Of the plugging methods described above, a disadvantage to be pointed out is that of the high proportion of manual labour required. Each plugging operation calls for a dedicated work phase, and, also, quite frequently, the use of a dedicated and expensive plugging material.

The present invention aims to overcome the disadvantages found in prior-art techniques and to provide an entirely novel method and apparatus for cutting prestressed hollow-cored concrete slabs.

The method is based on an instant cutting of hollow-cored slabs immediately after the casting phase while simultaneously filling the ends of the hollow cores using the excess mix from the cutting phase as a filler.

The method and apparatus of the present invention provides remarkable advantages. When using the method in accordance with the invention, the labour-intensive sawing phase is shortened and the manual labour-requiring operation of filling the core ends is replaced by the filling of the core ends already in conjunction with the instant cutting phase.

BRIEF DESCRIPTION OF THE DRAWINGS

In the following, the invention will be examined in more detail by means of an exemplifying embodiment illustrated in the attached drawings, wherein.

DETAILED DESCRIPTION OF THE INVENTION

Figure 1:
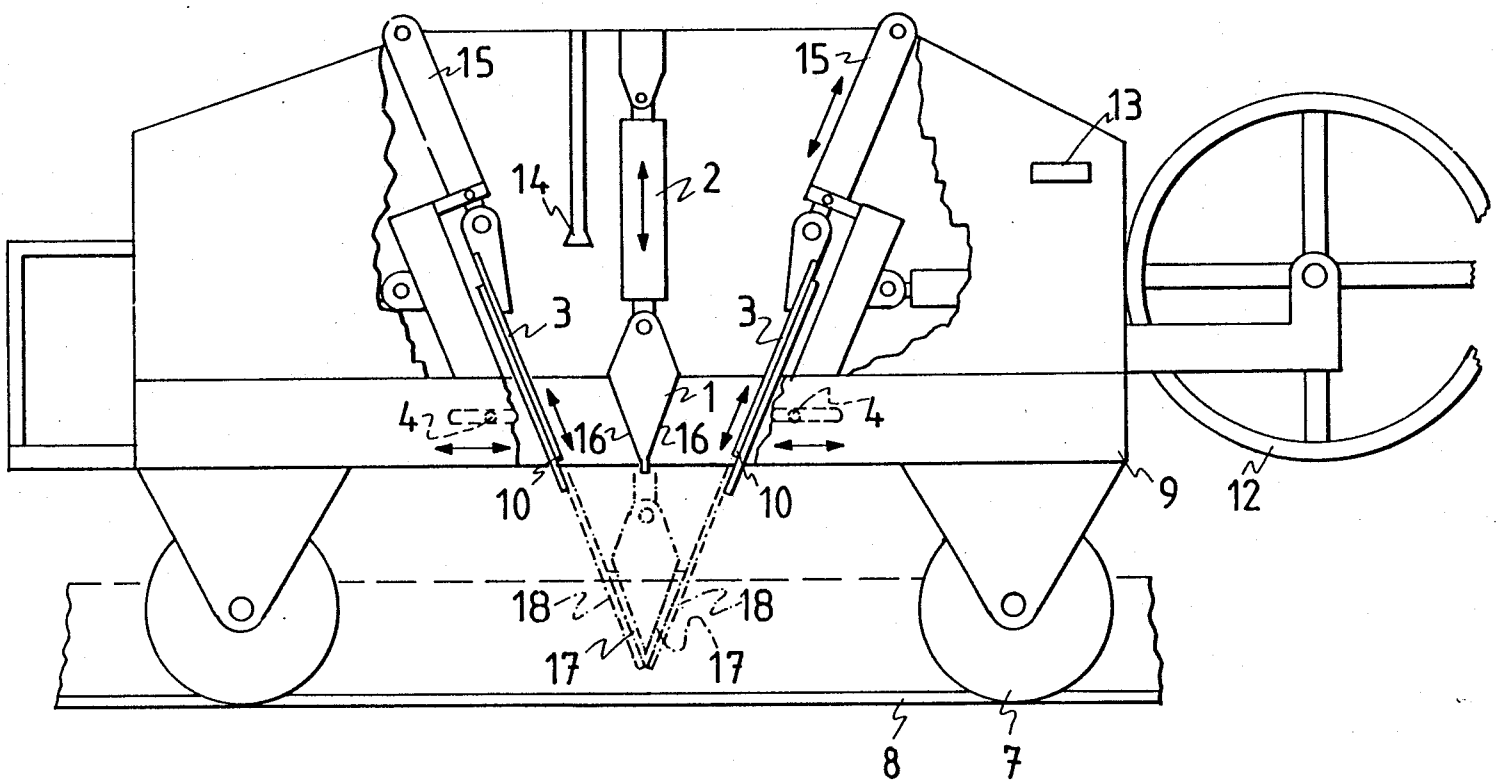
FIG. 1 is a partially cross-sectioned side view of a cutting apparatus in accordance with the present invention.
Figure 2:
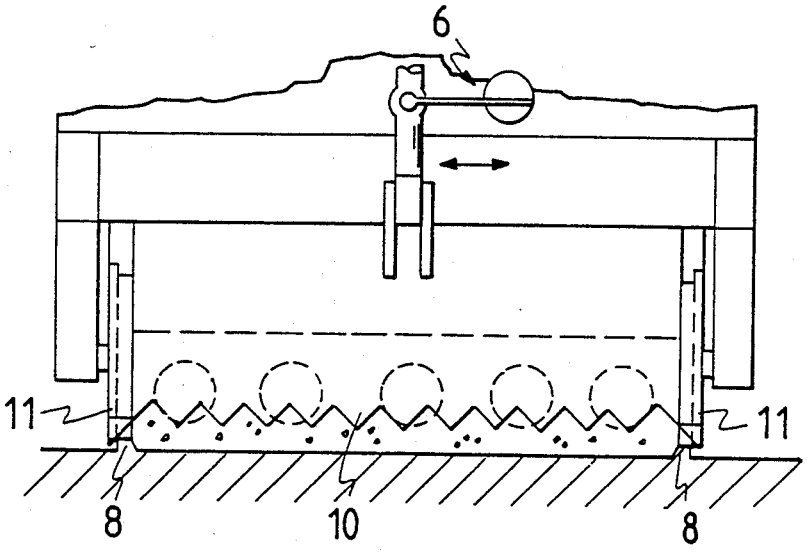
FIG. 2 is a partially cross-sectioned front view of the cutting apparatus shown in FIG. 1.

The present invention is based on arranging an instant-action cutting/plugging apparatus 9 which is movable and closely coupled to the slipforming extruder. The apparatus is movable on wheels 7 disposed on side rails 8 of the casting bed. Drive means for the apparatus is provided by a separate transfer motor 12. The apparatus has preferably a distance measuring device 13, with the help of which the apparatus is shifted forward on the casting line over the length of the slab element so as to locate an end cutting knife 1, which extends crosswise over the entire element width, at the separation point of the elements. After the apparatus is parked, cutting blades 3, mutually aligned in a V-shaped posture, are driven by means of an auxiliary mechanism 15 downward into the fresh unhardened mix, obliquely approaching each other in the mix. A tip 10 of the cutting blade 3 is preferably saw-shaped to advantageously help the blade 3 penetrate into the mix without distorting its cast shape. To aid penetration, the cutting blade 3 can be subjected to a sideways reciprocating motion by means of, e.g., a reciprocating actuator 6 implemented using a separate rotational drive and an eccentric cam disc. Sideways expansion of the mix is prevented by a mold wall 11 resting against the side of the fresh cast slab. The frequency of the reciprocating crosswise motion is 500 . . . 600 strokes/min, preferably approx. 300 strokes/min. The height of the cutting blade 3 is adjustable by means of a separate mechanical adjustment 4, which allows the adaptation of the apparatus into the fabrication of cored slabs of different heights.

When the cutting blades 3 are driven sufficiently deep towards their lower position, the operation of a wedge-shaped end cutting knife 1, which extends over the entire width of the cored slab, is started. The end cutting knife 1 is pushed with help of a mechanical actuator 2 down into the fresh, unhardened mix close to the cutting blades 3. To improve the cutting effect of end cutting knife 1, a crosswise reciprocating actuator 6 and a saw-shaped tip, similar to those of the cutting blades, can be used. Sides 16 of the end cutting knife facing the concrete mix are essentially parallel to the cutting blades 3. Prior to the start of the end cutting knife operation, the concrete mix of the cast slab can be moistened with help of a separate water spraying nozzle 14 in order to plasticize the extremely stiff mix. The downward penetration of the end cutting knife 1 through the unhardened mix to its lower position simultaneously creates an instant cutting gap between the opposing ends of the elements. The combination of the reciprocating motion, downward gravitational motion, and wedge-shaped form of the end cutting knife 1 works the mix between the cutting blade 3 and the knife 1 so that the mix is plasticized and transferred from the ridges as well as from the upper and lower surfaces of the slab into the open cores thus forming a homogeneous concrete mix sheet 17 from the original open core structure.

When the end cutting knife 1 has reached the desired lower position, the cutting blades 3 are lifted by means of a mechanical actuator 15 to an upper position. Because of the extremely thin construction of the cutting blades 3 and the sustained downward pushing action of the end cutting knife 1, the homogeneous concrete sheet 17 formed at the cutting point is not severed but instead remains in place during all cutting phases. When the cutting blades 3 are at their upper positions, the end cutting knife 1 further finalizes the seam formed between an end 18 of the slab and the homogeneous concrete sheet 17, which forms a plug at the end of slab, by compacting the voids formed at the ends by the withdrawal of the cutting blade 3. At this stage, the pushing action and a small crosswise shearing motion of the end cutting knife 1 compacts the concrete sheet 17 to adhere to the end 18 of slab thus plugging the cores of the slab. Finally, the end cutting knife 1 is lifted up by means of the mechanical actuator 2 to allow the transfer of the cutting apparatus to the next cutting point.

In the implementation of the method, the apparatus measures the length of elements, performs an instant cutting of the hollow-cored slab, and works appropriate plugging material from the excess mix remaining from the cutting operation, and plugs the cores of the hollow-cored slab in a single work phase.

The invention being thus described, it will be obvious that the same may be varied in many ways. Such variations are not to be regarded as a departure from the spirit and scope of the invention, and all such modifications as would be obvious to one skilled in the art are intended to be inclined within the scope of the following claims.

What is claimed is:

1. An apparatus for the instant cutting of hollow-cored slabs, including a frame mounted on wheels and cutting means mounted to the frame, said cutting means comprising two sheet cutting blades which are connected to the frame to extend over the entire width of the slab, said cutting blades being disposed in a V-shaped posture and provided with cutting tips, a first set of actuator means capable of pushing the cutting blades towards each other in said V-shaped posture and close to the lower surface of the hollow-cored slab, a wedge-shaped end cutting knife connected to the frame and extending over the entire width of the slab, said cutting knife having sides which are aligned essentially parallel to the cutting blades, and a second set of actuator means capable of pushing the wedge-shaped end cutting knife with a shearing motion through the gap between the cutting blades down towards the cutting tips of the blades in order to form a homogeneous sheet of concrete mix over the sides of the cutting knife facing the mix.

2. The apparatus as claimed in claim 1, wherein the cutting tips of the cutting blades are saw-shaped.

3. The apparatus as claimed in claim 1, wherein the first and second set of actuator means comprise means for the generation of a cyclic crosswise reciprocating movement.

* * * * *